United States Patent [19]

Nauheimer

[11] 4,376,507

[45] Mar. 15, 1983

[54] THREE-CELL PARTITION

[75] Inventor: James F. Nauheimer, Chicago, Ill.

[73] Assignee: Container Corporation of America, Chicago, Ill.

[21] Appl. No.: 300,440

[22] Filed: Sep. 8, 1981

[51] Int. Cl.[3] ..... B65D 5/48; B65D 3/24

[52] U.S. Cl. ..... 229/15; 229/28 R

[58] Field of Search ..... 229/15, 27, 28 R

[56] References Cited

U.S. PATENT DOCUMENTS

| | | | |
|---|---|---|---|
| 1,636,508 | 7/1927 | Goodyear | 229/28 R |
| 1,791,422 | 2/1931 | McVey | 229/15 |
| 2,724,540 | 11/1955 | O'Leary | 229/27 |
| 3,770,184 | 11/1973 | Rockefeller | 229/15 |
| 3,912,159 | 10/1975 | Danville | 229/15 |
| 3,931,924 | 1/1976 | Gardner | 229/15 |
| 3,997,102 | 12/1976 | Jones | 229/15 |
| 4,282,999 | 11/1981 | Moen | 229/15 |
| 4,335,842 | 6/1982 | Bradfurd | 229/15 |

FOREIGN PATENT DOCUMENTS

| | | | |
|---|---|---|---|
| 6613843 | 4/1967 | Netherlands | 229/15 |

*Primary Examiner*—Herbert F. Ross

*Attorney, Agent, or Firm*—Richard W. Carpenter; Davis Chin

[57] ABSTRACT

A partition structure formed from a one place blank of foldable sheet material for providing three cells within an outer wrapper or shipping container.

2 Claims, 5 Drawing Figures

THREE-CELL PARTITION

BACKGROUND OF THE INVENTION

1. Field of the Invention

This invention relates generally to partition structures and, more particularly, to a one-piece paperboard partition structure adapted to form three separate cells within an outer wrapper or shipping container.

2. Description of the Prior Art

A prior art search directed to the subject matter of this application in the U.S. Patent and Trademark Office disclosed the following patents: U.S. Pat. Nos: 137,791; 1,126,185; 1,157,712; 1,259,666; 1,791,422; 2,154,085; 2,888,185; 3,088,648; 3,260,440; 3,300,,076; 3,317,111; 3,519,191; 3,871,569; 3,921,891; 3,985,286; 3,997,102; 4,111,350; 4,171,762; 4,172,550; 4,226,357; British Pat. No. 399,536.

None of the prior art patents disclosed a partition structure formed from a unitary blank of foldable paperboard having two sections of equal length and width arranged in side-by-side relation with only two of the panels joined to each other.

SUMMARY OF THE INVENTION

This invention relates generally to partition structures and, more particularly, to paperboard partition structures of the type used to form inner cells or partitions within an outer wrapper or shipping container.

In order to provide partition structures formed from one piece blanks of paperboard, many partition structures require an extremely long narrow blank which is difficult to handle with conventional equipment and requires more time and expense.

It is an object of this invention to provide a partition structure which accomplishes the same effect as an elongated structure, but which is shorter in length and easier to handle.

A more specific object of the invention is the provision of a three-cell partition structure formed from a unitary blank of foldable paperboard comprising a pair of sections of approximately equal length and width arranged in side by side relation.

These and other objects of the invention will be apparent from an examination of the following description and drawings.

DESCRIPTION OF THE PREFERRED EMBODIMENT

Figure 1:
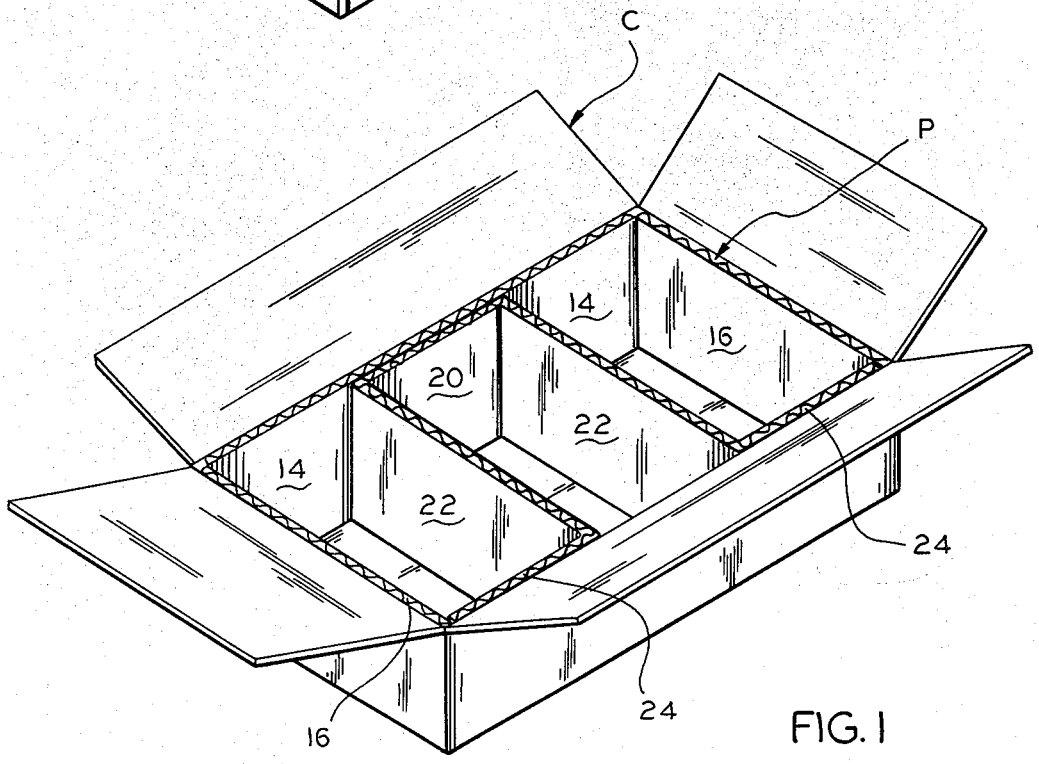
FIG. 1 is a perspective view of an outer shipping container within which has been placed a three-celled partition structure embodying feature of the invention.

Referring now to the drawings for a better understanding of the invention and particularly to FIG. 1, it will be seen that the partition structure indicated generally at P is adapted to be used within an outer wrapper or shipping container indicated generally at C. Partition P may be formed from the unitary unitary blank B of foldable sheet material illustrated in FIG. 3.

As previously mentioned, one of the disadvantages of forming a partition from an elongated blank which is narrow and includes a plurality of panel sections all joined to each other in end to end relation, is that blanks of this type are difficult to handle with conventional handling and forming equipment. It is therefore intended that this blank be shorter in section, and this is accomplished by forming the blank with a pair of sections 10 and 12 which are of substantially equal length and width and which are disposed in parallel side-by-side relation so as to occupy a minimum of space and provide for an efficient use of material.

Figure 2:
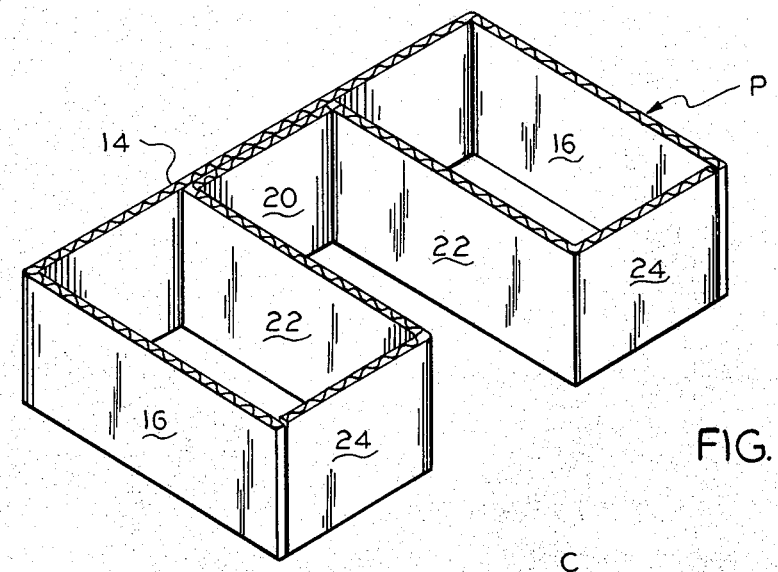
FIG. 2 is a perspective view of the partition structure illustrated in FIG. 1.
Figure 3:
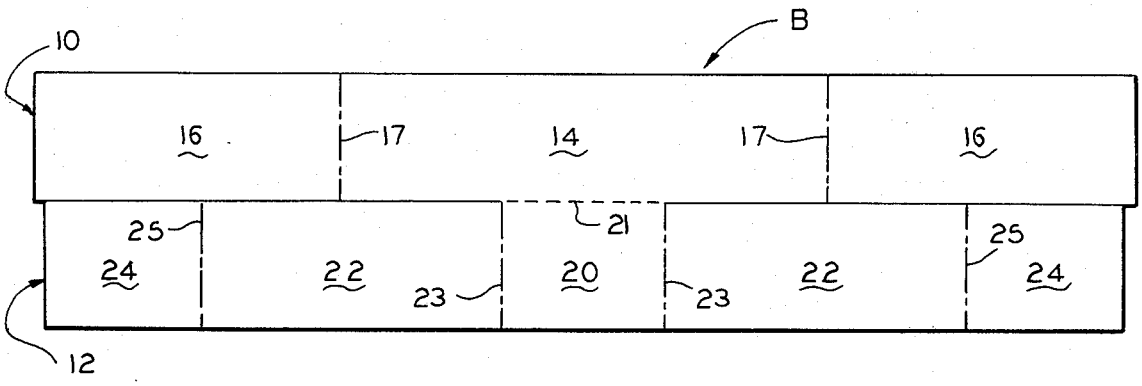
FIG. 3 is a plan view of a blank of foldable sheet material from which the partition structure illustrated in the previous views may be formed.
Figure 4:
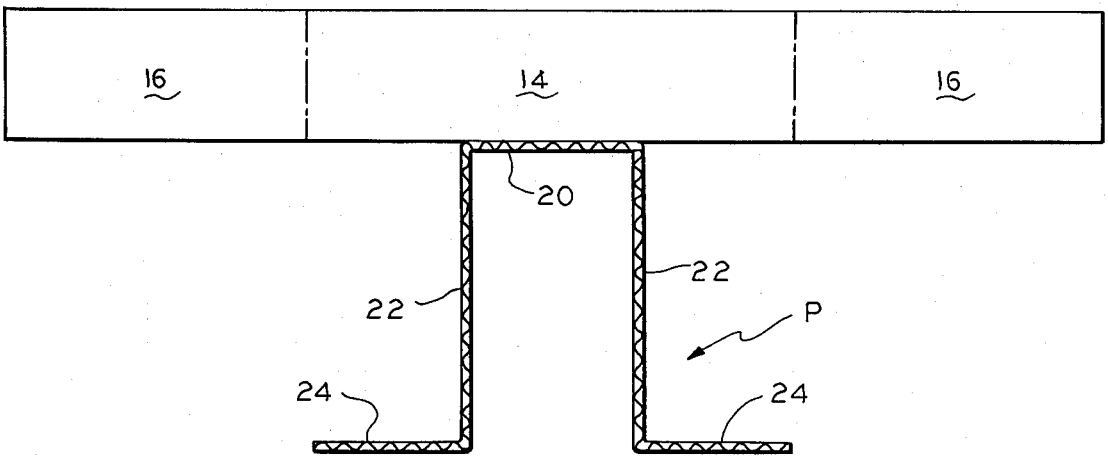
FIG. 4 is a plan view of the structure illustrated in FIG. 3, but showing one stage in the erection of the partition structure from the blank.
Figure 5:
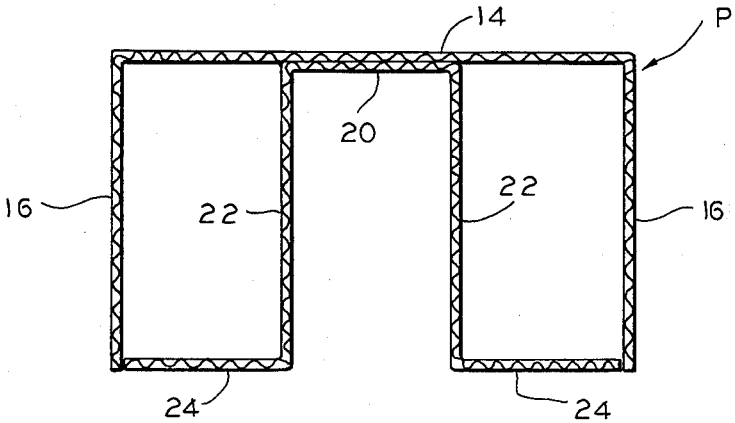
FIG. 5 is a plan view of the completely assembled partition It will be understood that for purposes of clarity certain elements may have been intentionally omitted from certain views where they are believed to be illustrated to better advantage in other views.

As best seen in FIGS. 2 and 3, first section 10 of blank B includes a major side panel 14 having a pair of end panels 16 foldably joined to opposite end edges thereof on fold lines 17.

Second section 12 of blank B includes a centrally located first minor side panel 20 which is foldably joined at a side edge on fold line 21 to a central portion of an adjacent side edge of major side panel 14 of section 10 of blank B. A pair of intermediate panels 22 are foldably joined at their inner end edges to opposite end edges of the first minor side panel 20 on fold lines 23. Section section 12 of blank B also includes a pair of second minor side panels 24 which are foldably joined at their inner edges to adjacent outer edges of related intermediate panels 22 along fold lines 25.

In forming the partition P from the blank B, it will be seen that the major side panel 14 and the first minor side panel 20 are folded 180° so as to lie in back-to-back relation as shown in FIGS. 1 and 2. End of panels 16 are folded inwardly at right angles from first major side panel 14. Also, intermediate panels 22 are folded inwardly at right angles from first minor side panel 20 and second minor side panels 24 are folded outwardly at right angles to intermediate panels 22.

Thus, when the structure is formed, as shown in FIG. 2, and is inserted within an outer container C, the major side panel 14 of the structure is adapted to lie against an inner face of one of the sidewalls of the outer container, with the end panels 16 lying against inner faces of opposed end walls of the container. The intermediate panels 22 are disposed to extend between the two sidewalls with the second minor side panels 24 lying against the other sidewall of the container and extending between the intermediate panels and the end panels to provide three separate cells within an outer container.

It is to be noted that the partition structure panels are so arranged that no raw edges or corners of the partition are exposed, which could cause damage to a packaged article.

Thus, it will be seen that the invention provides a partition arrangement of relatively simple design and construction.

What is claimed is:

1. A partition structure, formed of a unitary blank of foldable paperboard having two sections arranged in parallel side-by-side relation, for providing three separate cells within an outer container or wrapper, said partition structure comprising:

(a) a major side panel adapted to lie against a major sidewall of an outer container and having foldably joined to opposite end edges thereof on parallel fold lines a pair of end panels adapted to lie against opposed end walls of said outer container;

(b) a first minor side panel adapted to lie against a central portion of said major side panel and having one edge joined to an adjacent edge of said major side panel along a fold line which is disposed normal to said parallel fold lines;

(c) a pair of intermediate panels having corresponding end edges foldably joined to opposite end edges of said first minor side panel and extending normal to said major side panel in parallel relation with said end panels;

(d) a pair of second minor side panels foldably joined at corresponding end edges to adjacent end edges of respective intermediate panels and adapted to extend between said intermediate panels and said end panels and to lie against another major sidewall of said outer container.

2. A unitary blank of foldable sheet material, such as paperboard, which is cut and scored to provide a partition for forming three cells within an outer container or wrapper, said blank comprising:

(a) a pair of first and second sections of substantially equal length and width and being disposed in parallel side-by-side relation;

(b) said first section including:

(i) a major side panel;

(ii) a pair of end panels foldably joined to opposite end edges of said major side panel;

(c) said second section including:

(i) a first minor side panel foldably joined at a side edge adjacent a side edge of said first section major side panel;

(ii) a pair of intermediate panels foldably joined to opposite end edges of said minor side panel;

(iii) a pair of second minor side panels foldably joined to adjacent outer end edges of respective intermediate panels.

* * * * *